US010584867B2

(12) United States Patent
Sigurdson

(10) Patent No.: US 10,584,867 B2
(45) Date of Patent: Mar. 10, 2020

(54) LIGHTED SPORTS COURT FLOOR MOP

(71) Applicant: Roy Allen Sigurdson, Seaside, OR (US)

(72) Inventor: Roy Allen Sigurdson, Seaside, OR (US)

( * ) Notice: Subject to any disclaimer, the term of this patent is extended or adjusted under 35 U.S.C. 154(b) by 0 days.

(21) Appl. No.: 16/448,280

(22) Filed: Jun. 21, 2019

(65) Prior Publication Data

US 2019/0390852 A1 Dec. 26, 2019

Related U.S. Application Data

(63) Continuation-in-part of application No. 16/014,884, filed on Jun. 21, 2018, now abandoned.

(51) Int. Cl.

| | |
|---|---|
| ***F21V 33/00*** | (2006.01) |
| ***A47L 13/24*** | (2006.01) |
| *F21Y 115/10* | (2016.01) |

(52) U.S. Cl.

CPC ..... *F21V 33/004* (2013.01); *A47L 13/24* (2013.01); *F21Y 2115/10* (2016.08)

(58) Field of Classification Search

CPC ..... F21V 33/0044; A47L 13/20–258; F21Y 2115/10

See application file for complete search history.

(56) References Cited

U.S. PATENT DOCUMENTS

| | | | | |
|---|---|---|---|---|
| 7,300,172 | B1 * | 11/2007 | Lefler | A47L 9/2836 362/191 |
| 2006/0215391 | A1 * | 9/2006 | Jones | A46B 15/0002 362/91 |
| 2008/0301903 | A1 * | 12/2008 | Cunningham | A47L 9/281 15/410 |
| 2009/0059569 | A1 * | 3/2009 | Quattrini, Jr. | A46B 15/0002 362/119 |
| 2013/0232713 | A1 * | 9/2013 | Luedke | A47L 13/225 15/228 |
| 2014/0245555 | A1 * | 9/2014 | Thorne | A47L 13/24 15/228 |
| 2014/0259510 | A1 * | 9/2014 | Conrad | A47L 13/225 15/319 |
| 2014/0259516 | A1 * | 9/2014 | Scolari | A47L 13/225 15/322 |

(Continued)

*Primary Examiner* — Gerald J Sufleta, II
(74) *Attorney, Agent, or Firm* — Mark S Hubert

(57) ABSTRACT

A lighted sports court floor mop designed for drawing visual attention to itself. It has a circular mop body with a ring of downward facing LEDs imbedded about the entire perimeter of the mop head body. These LEDs face downward when the mop head is in use on the floor, and are not visible when the mop is in use, as they are embedded in the bottom face of the mop head. The light emitted from these LEDs is not directly visible when the mop is in use but rather the light directly emitted from the LEDs is reflected off of the floor to outside of the mop body so the viewing public sees the illusion that the mop body is floating above the court floor. A video display panel may be optionally mounted on the top deck of the mop head that is horizontally or vertically disposed. The lights and video display panel are operated by a pole handle mounted switch that operates the control module. The control module and its power source are housed in the mop body.

13 Claims, 8 Drawing Sheets

(56) References Cited

U.S. PATENT DOCUMENTS

| | | | | |
|---|---|---|---|---|
| 2016/0131345 | A1* | 5/2016 | Ammer | F21V 21/0885<br>362/183 |
| 2017/0127903 | A1* | 5/2017 | Grandstrand | A47L 11/4086 |
| 2018/0000303 | A1* | 1/2018 | Conrad | A47L 7/0085 |
| 2018/0249880 | A1* | 9/2018 | Tidwell | A47L 13/12 |
| 2018/0360290 | A1* | 12/2018 | Perry | A47L 11/4091 |

* cited by examiner

FIG. 6
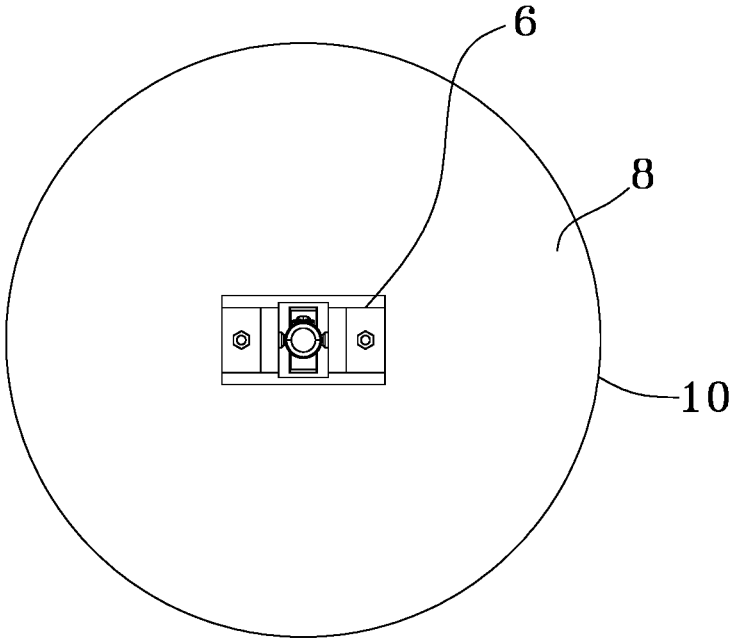
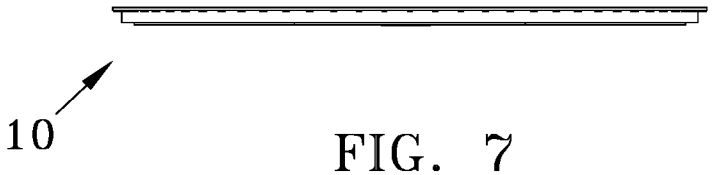
FIG. 7

FIG. 8
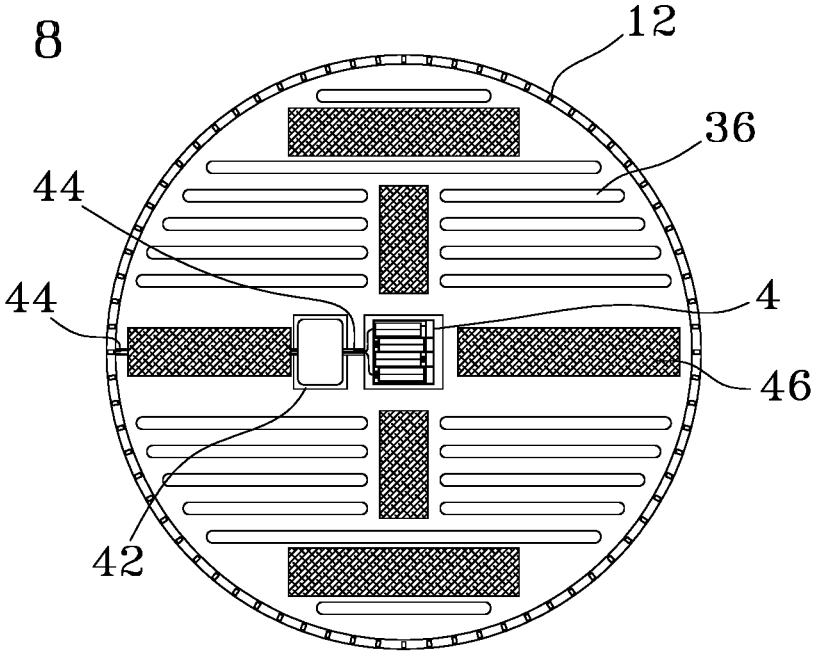
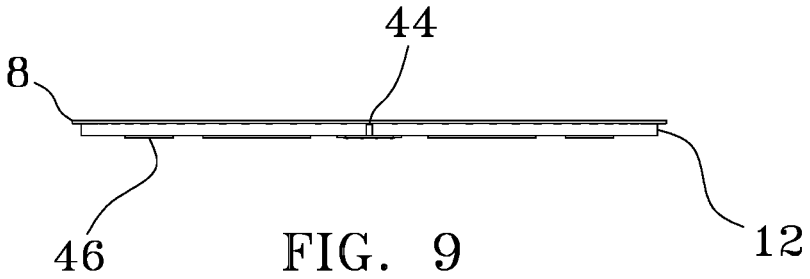
FIG. 9

FIG. 15
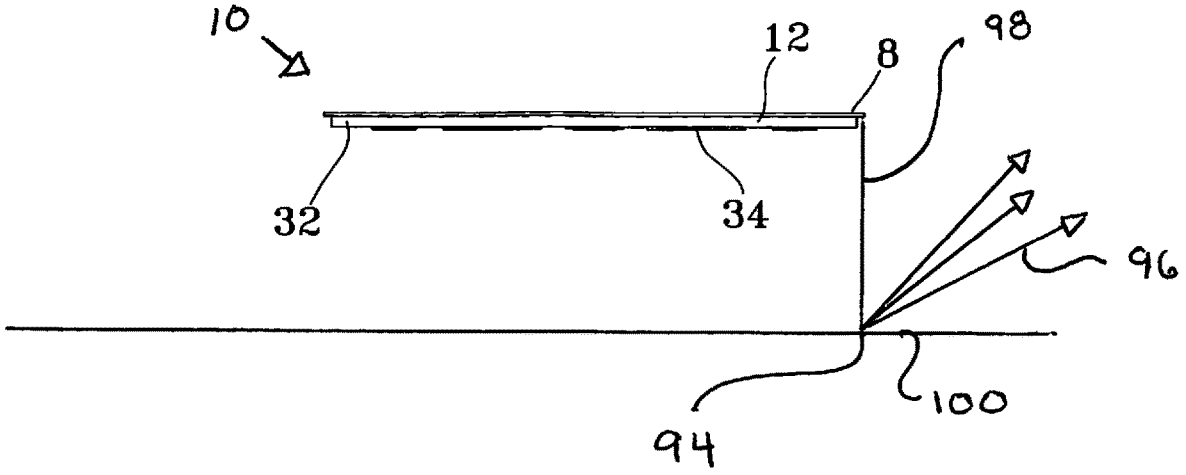
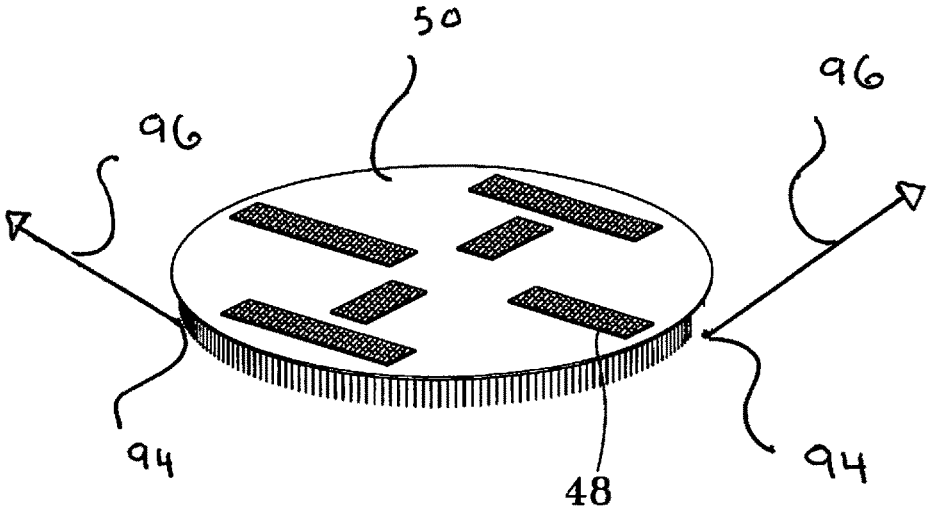
FIG. 16

LIGHTED SPORTS COURT FLOOR MOP

PRIORITY

This application claims priority to and is a Continuation-in-Part of pending U.S. Utility patent application Ser. No. 16/014,884 entitled Lighted Sports Court Floor Mop, filed Jun. 21, 2018.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a technologically advanced, manual floor cleaning device, and more particularly to a mop designed for cleaning sports arena floors (courts) in front of a crowd, and drawing attention to itself.

BACKGROUND

Arenas hosting sporting events such as basketball and volleyball have an ongoing need to mop up sweat and spilled liquids from their court floors. The sweat drips from the players and is deposited in large areas when a player falls on the court floor. Drinks from water bottles on the edge of the court floor often leak onto the floor and occasionally fans throw a cup or bottle onto the court. Certain areas such as under the basketball hoop, along the volleyball net and around the free throw line, tend to accumulate more liquids than others.

Generally, sports arena court floors are constructed of plank hardwood that has been finished to a mirror like gloss. Fluids on the court make a slipping hazard for the athletes. Since many of the athletes playing in these arenas are under multi-million dollar contracts, all efforts must be made to ensure their safety. Thus an ongoing, vigilant watch for fluids on the court floor is conducted during high-level amateur and professional sporting events.

When sighted, the fluid must be quickly mopped up during referee calls and other momentary breaks in the sports action. This mopping takes place during the event on breaks between the action. Since it is done in front of thousands of local spectators and potentially millions of media viewing people, the mop has the potential for high visibility.

Henceforth, a manual court floor mop that would draw attention to itself for short periods of time and capitalize on its large, briefly captive audience, would create a new niche need in the advertising industry. This new invention utilizes and combines known and new technologies in a unique and novel configuration to accomplish this.

BRIEF SUMMARY

In accordance with various embodiments, a manual court floor mop is provided.

In one aspect, a mop with various visual enhancements to draw attention to itself is provided.

In another aspect, a universally directional manually pushed mop with an illuminated periphery, and a logo bearing top deck is provided.

In yet another aspect, a universally directional mop with replaceable absorbent pads and a top deck with at least one electronic video display panel is provided.

In a final aspect a manually pushed mop with a periphery illuminated by a black light, an ultraviolet—C light or an IR light.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 6 is a top view of the preferred embodiment mop body;

FIG. 7 is a front side view of the preferred embodiment mop body;

FIG. 8 is a bottom side view of the preferred embodiment mop body;

FIG. 9 is a left side view of the preferred embodiment mop body;

FIG. 15 is a side view of the mop body suspended at a distance above a court floor showing the direct and reflected light rays; and FIG. 16 shows the illusion seen by the court spectators as created by the reflected light rays with respect to the mop pad.

DETAILED DESCRIPTION OF CERTAIN EMBODIMENTS

Figure 1:
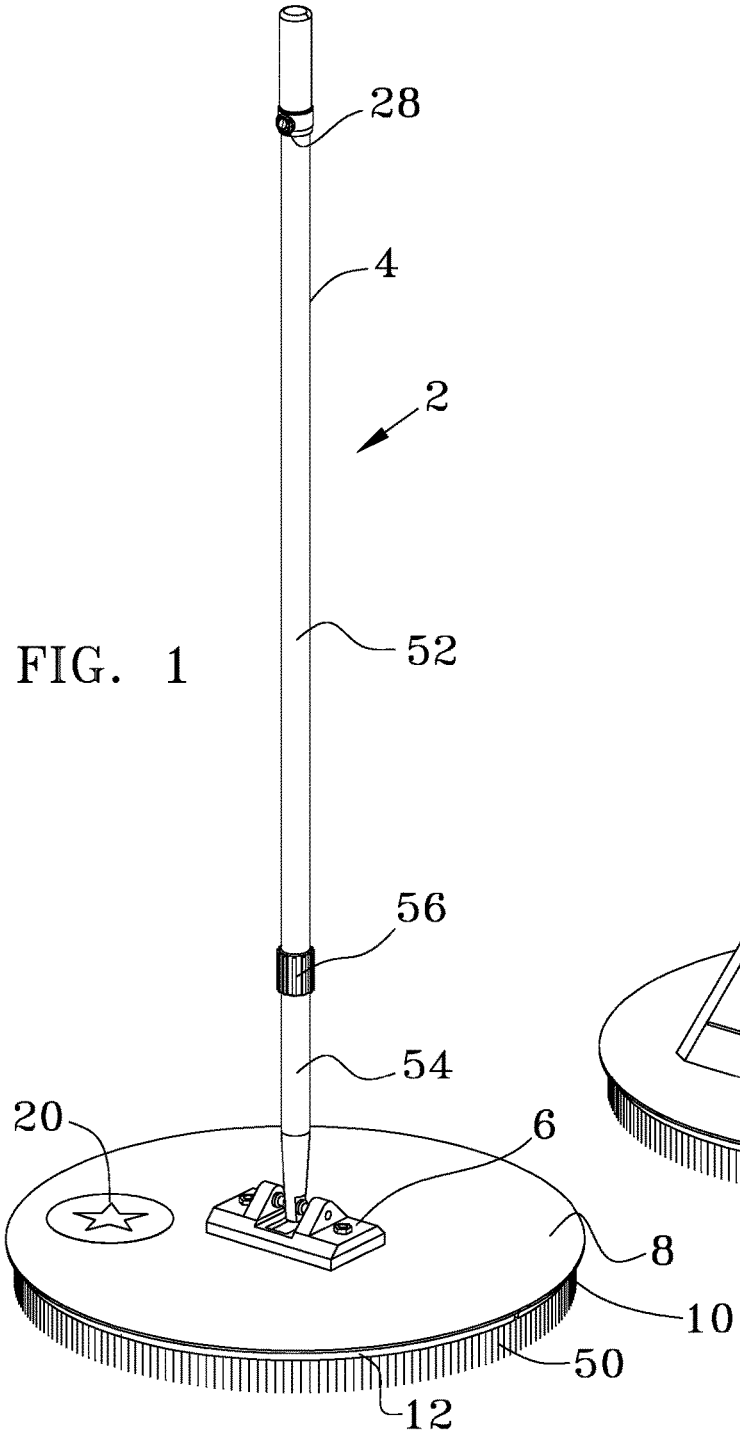
FIG. 1 is a perspective view of the preferred embodiment mop.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. It should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "universally directional mop" refers to a mop that may be moved in any direction by its handle with equal absorbent capabilities. Since the present mop body has a circular configuration rather than linear or rectangular configuration, and a central push point, it can be moved in any direction with equal cleaning abilities.

As used herein, the term "biaxial hinge" refers to a mechanical device that allows simultaneous movement along two planes that reside perpendicular to each other. When connected between the pole handle and the mop body it facilitates pushing of the mop head in any direction yet prevents the axial rotation of the pole handle with respect to the mop body.

As used herein, the term "downward" refers to the direction the mop head faces when in use, sweeping a court floor. In other wards the direction that faces the ground.

As used herein the term "directly emitted light rays" are those rays emitted from a light source that are capable of being perceived by the eye before reflecting off of a surface.

As used herein, the term "reflected light rays" refer to the light rays emitted from a light source that are perceivable by the eye of a viewer only after reflection off of a surface, such as a floor.

The present invention relates to a novel design for a geometrically shaped, universally directional mop, with a downward illuminating ring of lights about its peripheral edge and a decorated top deck on its mop body. The lights themselves as well as their direct light rays are not visible to spectators when the mop is in use because of their proximity to the floor and their downward facing design. The first and second alternate embodiment mops substitute planar video display panels for the decoration on the top deck. They are intended for the quick, accident responsive clean-up of fluids from a sports court floor. In alternate embodiments different types of light are used.

Figure 4:
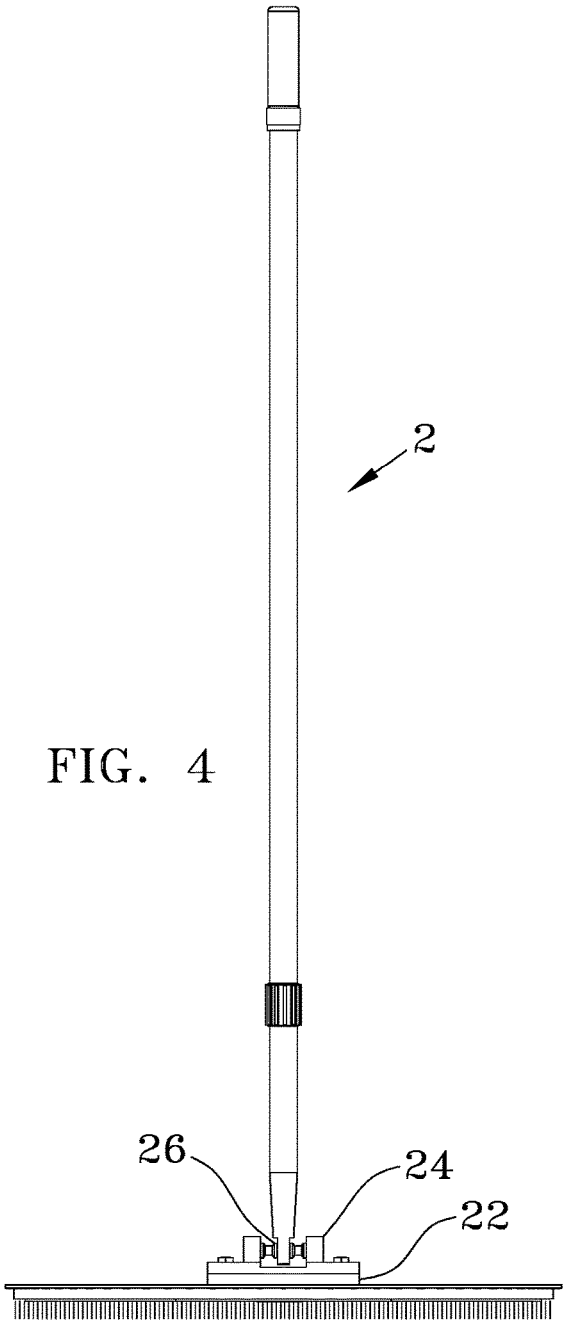
FIG. 4 is a front side view of the preferred embodiment mop.
Figure 5:
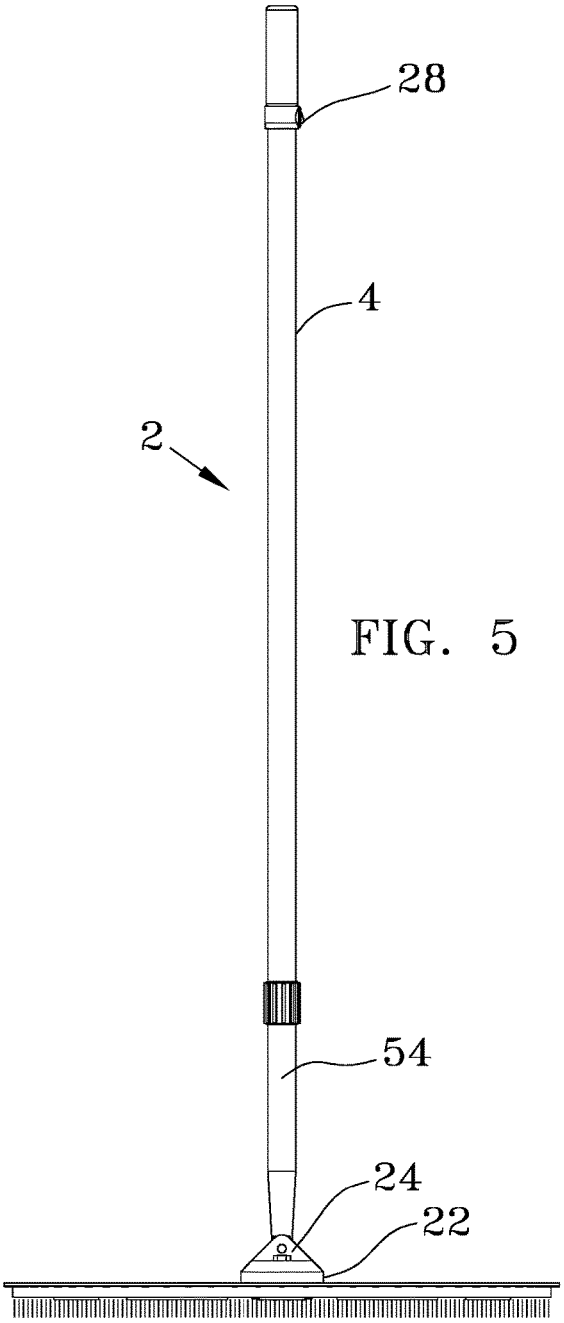
FIG. 5 is a side view of the preferred embodiment mop.
Figure 10:
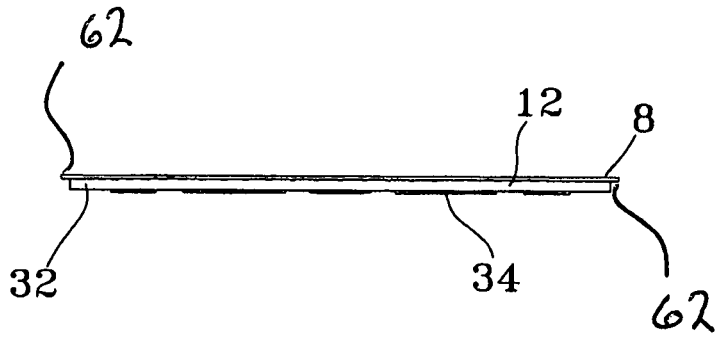
FIG. 10 is a right side view of the preferred embodiment mop body.

Looking at FIGS. 1, 4 and 5, it can be seen that the preferred embodiment mop 2 has a circular cylindrical pole handle 4 affixed to a biaxial hinge style swivel 6 that is mounted to and extends centrally from the upper surface of the top deck 8 of the circular mop body 10. There is a ring of LED lights 12 (preferably continuous, and equally spaced) about the entire peripheral edge of the bottom surface 60 of the top deck 8. Looking at FIGS. 10 and 11 it can be seen that this peripheral edge forms an overhang 62 beyond the core disk 32 to provide the mounting space for the ring of LED lights 12, allowing for them to shine downward onto a court floor. In the preferable embodiment, these lights emit light in the visible spectrum although in alternate embodiments the lights may emits other frequencies of light.

Figure 2:
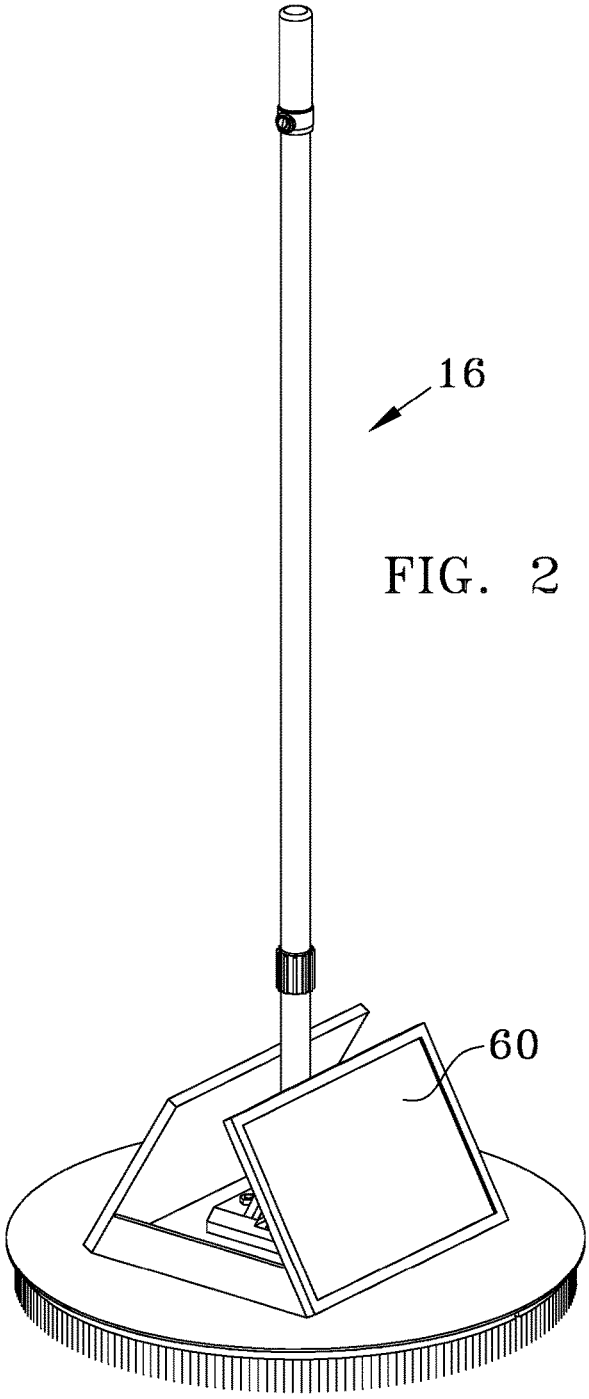
FIG. 2 is a perspective view of the first alternate embodiment mop.

An absorbent mop pad 50 is affixed by hook and loop fasteners to the bottom face of the mop body 10. The swivel 6 on the preferred embodiment mop 2 and the first alternate embodiment mop 16 (FIG. 2) are located centrally whereas the swivel 6 on the second alternate embodiment mop 18 (FIG. 3) is located adjacent the edge of the top deck 8.

The pole handle 4 is a length extendible cylinder with a central longitudinal bore formed therein. In its simplest configuration, the handle 4 is made of a first smaller diameter inner tube 52 frictionally nestled inside a second, larger diameter tube 54. The two tubes are frictionally engaged by a twisting lock ring 56 as is well known in the industry. Equivalent length extendible designs include multi nestled tube "telescoping aerial" designs. The central bore acts as a wire chase to route the wires between the pole handle's surface mounted power switch 28 and the control module 42 (FIG. 8). In the preferred embodiment the pole handle 4 is made of aluminum and has an advertising decal wrapped around its outer surface. Other materials of construction include extrude able polymers such as PVC, HDPE, LDPE and the like.

The top deck 8 of the mop body 10 is a planar, polycarbonate circular disk that serves as a surface for the mounting of a decal style advertisement 20 and the swivel 6. This advertisement 20 may be interchangeable and held on magnetically, with hook and loop attachment pads, mechanical fasteners or an adhesive. In the preferred embodiment mop 2 this advertisement is a digital vinyl decal (generally the logo of the of the hosting team) that is made in a large format digital printer from stock with adhesive calendared on one side. It is waterproof, chemically resistant and for visual aesthetics, covers the entire top deck 8. It is applied to the top deck 8 before the swivel 6 is attached.

Looking at the mop body 10 (FIGS. 7-10) it can be seen that in the preferred embodiment it has a polycarbonate circular disk top deck 8 with a peripheral ring of LED lights 12 mounted atop a planar core disk 32 that houses the power supply 38 and control module 30. The core disk 32 is made of a resilient rigid polymer foam with a series of voids 36 formed therein to lighten the mop body 10. In the preferred embodiment this would be a PVC foam (commonly used for signage). The core disk 32 is used to protect and elevate the ring of LED lights 12 off of the floor. A typical thickness for this core disk 32 would be ⅝ of an inch although there is a wide range of acceptable thicknesses. The factor determining the thickness of the core disk beyond the minimum thickness of the power supply 38 and the control module 30, is the visual aesthetics of reflection of the LED lights off of the court floor. This is dependent on the number, intensity and color of the ring of LED lights used.

The structural design, type and placement of the LED lights is critical to the function of this mop. That is, to create an illusion that the mop is floating when in use. The lights used on this mop, unlike all other lighted mops of the prior art, are not used to illuminate around the mop so the janitor can see debris on the mopped surface. The LED lights are placed too close to the floor for this function, generally being within ½ to 6 inches above the floor and bottom face of the absorbent mop pad 50 and within ⅛ to 6 inches above the bottom face of the mop body. Rather, the LED lights point their directly emitted light rays downward, toward the ground around the periphery of the mop pad 50 so that there is no illumination of the path far enough ahead of, or around the mop, to be of any assistance in spotting debris on the floor. The directly emitted light rays are so short, so directional, and so close to the floor when in use, that they are not perceivable to the spectators. The LED lights themselves are so small and also spaced at a distance back from the exterior periphery of the mop head 10 enough so as not to be visible from the point of view of a spectator or even the mop operator when in use. To see the LED light structures, the mop body must be inverted.

Only the reflected light rays off of the court floor are visible. These light rays are reflected off of the floor from all points about at the 360 degree perimeter of the mop pad on the mop body. The array of LED lights in the preferred embodiment illuminate the floor about the mop perimeter for a very short outward distance, preferably no further than two inches however, with thicker specialty mop pads and mop bodies this distance may be increased to a foot or more.

This accomplishes two things. First, creates an illusion that the mop is floating above the floor. Second, because of the LED's proximity to the floor, they reflect or bounce a bright light at the mop edge such that the janitor can see a change in the glare of the reflected light when there is water (usually sweat) still present on the court floor.

Functionally, for helping the janitor see particulate debris in the area of the floor around the mop, these LEDs are functionally useless. They have no forward illumination about the mop. However, for their intended two purposes or drawing the spectator's attention and mopping up water from the floor, they are excellent.

Referring to FIGS. 15 and 16 the use and floating mop illusion created by the present invention can best be explained. Looking at FIG. 15, a side view of the mop body suspended at a distance above a court floor, it can be seen that the LED lights 12 emit light directly downward toward the court floor (direct emitted light rays 98) striking the floor at point 94. That is to say, the emitted light from each LED is directed in a single downward direction rather than 360 degrees completely about its configuration as in standard globe shaped lightbulbs. To a spectator viewing the mop from the stands, this direct emitted light ray 98 is not visible or perceivable. However, when the direct emitted light rays 98 strike the court floor 100 they reflect at a host of angles which are outwardly reflected light rays 96 which can be seen by the spectators.

The floating mop illusion is created because the array of LED lights is in close enough proximity above the floor such that the array of LED lights are not visible to the spectators and the only light visible to spectators in the vicinity of said mop when in use, from the array of LED lights is the narrow ring of reflected light rays off of the floor around and adjacent the perimeter of the mop pad/mop body. In the preferred embodiment this narrow reflected light ring is less than two inches in width although in alternate embodiments it may be as wide as 6 inches.

Looking at FIG. 16, showing a perspective view of the mop pad and the illusion seen by the court spectators as created by the outwardly reflected light rays 96 is best understood. Here, it can be seen that what the spectator sees is light emitting from all directions in a ring 360 degrees around but below the mop pad on the mop body. This creates the illusion that the light is emanating from a point 94 below the mop pad so that it appears the entire mop is floating above the court floor, drawing the attention of the spectator to look at the mop. (Since there is a ring of LED lights, this point will actually be a ring.) These longer lingering looks allow time for the spectator to view the advertising on the mop.

There is a power supply void 40, a control module void 42, and a wire chase void 44 formed in the core disk 32. The wire chase void 44 serves as a channel for the placement and protection of the wires running from the power supply 30 to the control module 32 to the LEDs and the video display panels. The power supply 38 is affixed within the power supply void 40 and the control module 30 is affixed within the control module void 42. The power supply 38 and the control module 30 each have thicknesses less than the depth of their voids in the core disk 32. This prevents them from extending beyond the bottom face of the core disk 32 and contacting fluids or foreign objects as the mop passes over on the court floor.

Figure 11:
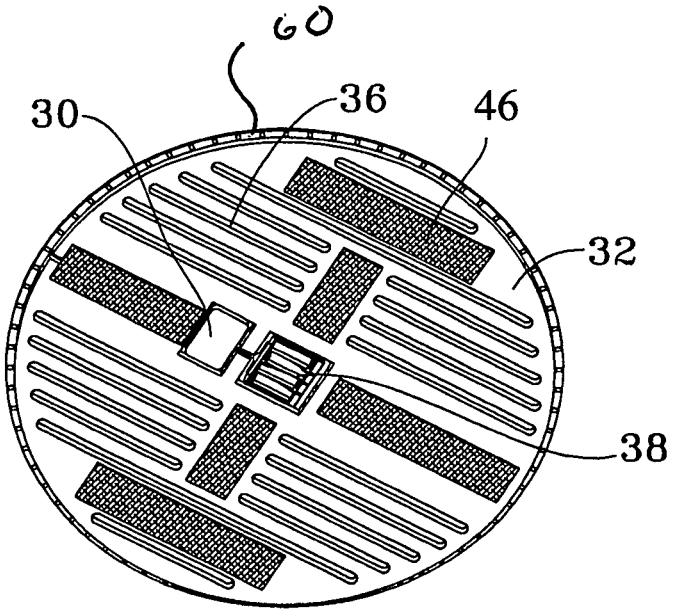
FIG. 11 is a perspective view of the bottom side of the preferred embodiment mop.
Figure 12:
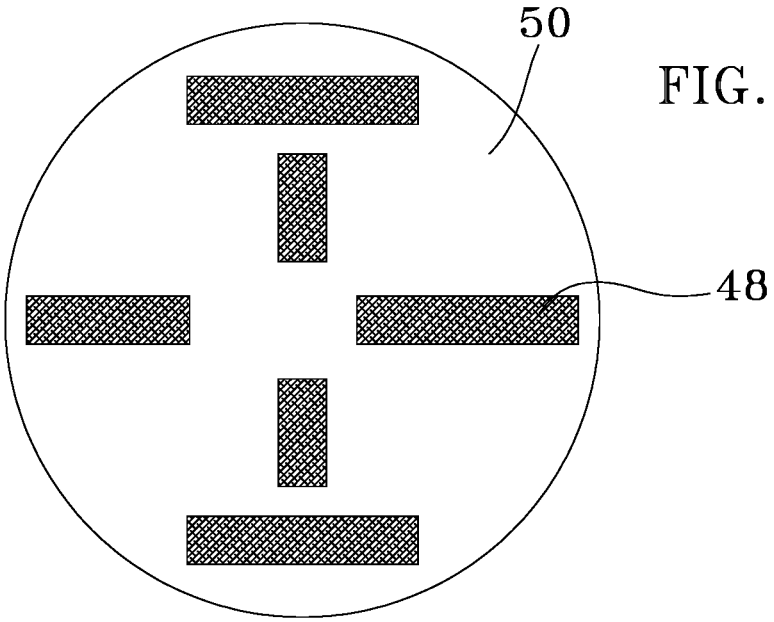
FIG. 12 is a top view of the absorbent mop pad.
Figure 13:
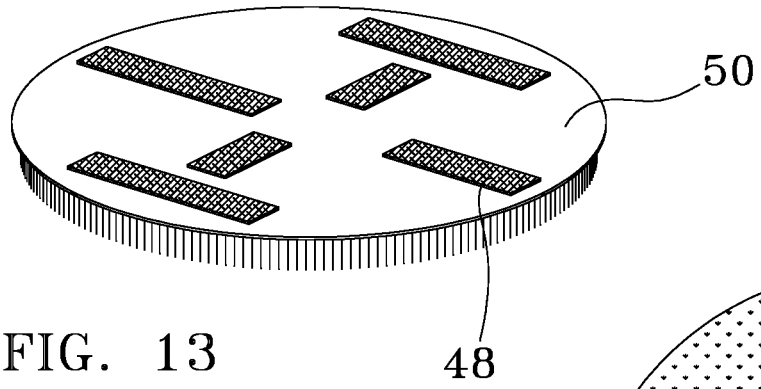
FIG. 13 is a perspective top view of the absorbent mop pad.
Figure 14:
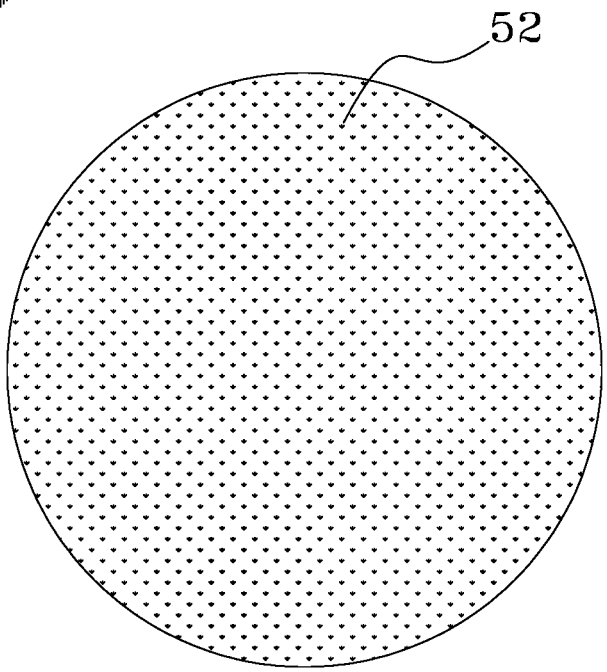
FIG. 14 is a bottom view of the absorbent mop pad.

As FIG. 11 shows, the core disk 32 also has patches of a hook and loop fastener 46 on its bottom surface that matingly engages a complementary hook and loop fastener patch 48 on the upper surface of the absorbent pads 50. (FIGS. 12 and 13) The absorbent pads 50 have a lower surface 52 made of a loop pile microfiber or equivalent fabric, (FIG. 14) engineered for maximum absorbency and low friction. The absorbent pads are re-useable and replaceable for laundering. There may be a disinfecting agent integrated with the loop piles.

Looking at FIG. 6, it can be seen that the biaxial hinge swivel 6 on the top deck 8 of the mop body 10 has a base plate 22 with a pair of parallel arms 24 extending vertically upward therefrom that constrain a cylindrical axle rod 26 between them. There is an axial bore between formed in the bottom end of the pole handle 4 through which the axle rod 26 passes. This allows the pole handle 4 to pivot about the mop body 10 in a vertical plane. There is an abundance of operational tolerance between the axle bore's internal diameter and the external diameter of the axle rod 26. This allows movement of the pole handle 4 in two planes residing perpendicular to each other. There is a plethora of different mechanically equivalent biaxial hinge swivels known in the industry that could be substituted. This style of pivot 6 is critical as the swivel 6 must constrain the pole handle 4 from rotational movement that could twist, stretch or damage the control wires that run between the control switch 28 and the control module 30 through the linear bore running down the length of the pole handle 4 (not illustrated). Although not illustrated, an equivalent swivel would allow the pole handle 4 to pivot in two planes that intersect at 90 degrees yet still not rotate.

The first alternate embodiment 16 has at least one flat screen video display panel 60 mounted thereon the top deck 8 of the mop body 10. The illustrated version in FIG. 2 has two video display panels 60 mounted back to back, at an acute angle between the horizontal and vertical planes. This angle may be adjusted to match the slope of the spectator stands or the overhead lighting. There may be multiple video display panels 60 arranged in a triangle, square or other geometric configuration. The video display panels 60 when switched on will show video advertising, play recorded play clips of the game, or any other video clip. The video signal may come from a prerecorded source such as a USB drive located on the panel itself, be input from the control module or streamed via wireless source to a wireless transceiver in the video display panel 60 or the control module 30.

Figure 3:
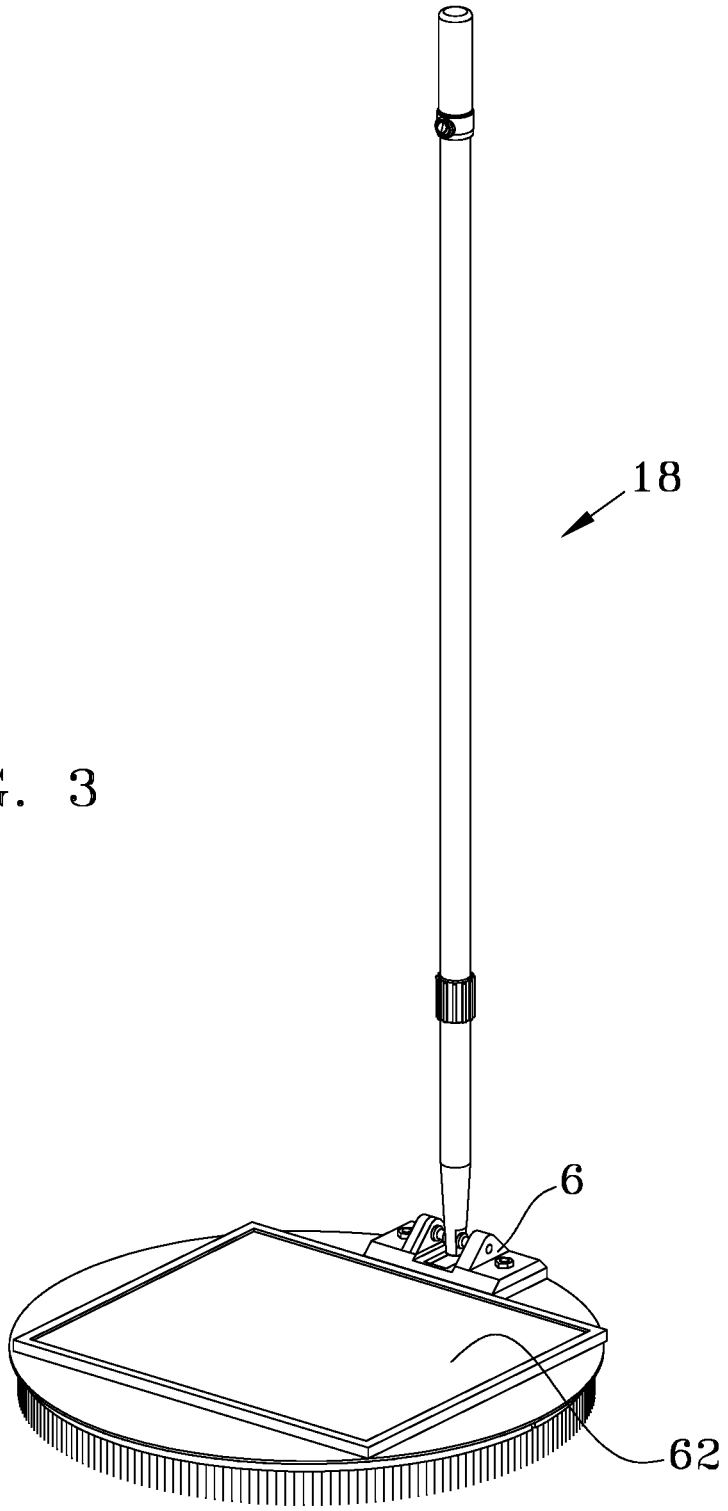
FIG. 3 is a perspective view of the second alternate embodiment mop.

As seen in FIG. 3, the second alternate embodiment has an ultra thin video display panel 62 affixed horizontally to the top top deck 8 of the mop body 10 rather than disposed vertically. For aesthetics, the ultra thin video display panel 62 would extend to the extents of the periphery of the top deck 8. Since this video display panel encompasses the entire top surface of the top deck 8, the swivel 6 must be relocated to the peripheral edge of the mop body 10.

The third alternate embodiment is identical to the preferred embodiment except that the ring of LED lights are replaced with Germicidal UV-C LED lights. This provides an efficient and cost-effective method to effectively disinfect surfaces with no hazardous waste or byproducts. It can also remove harmful and toxic chemicals produced in industries such as printing, plastics and rubber, or wood). Preferably most of the UV-C light energy will be focused at 254 nm, the most effective germicidal wavelength in the entire UV light spectrum. This attacks DNA-based airborne pollutants and mold spores by breaking DNA molecular bonds, rendering them unable to reproduce. Germicidal UV illumination has growth potential in residential, commercial, industrial, health care and education markets especially in hospitals, nursing homes, methadone clinics, rehabilitation centers, TB clinics, schools, doctor's offices or homes.

In other alternate embodiments the ring of LED lights in the preferred embodiment are replaced with black light LED or IR LED lights or UV lights of a wavelength different than 254 nm.

In operation, the ring of LED lights 12 or video display panels are powered from the control module 30, which distributes power from the DC power supply 38 when the power switch 28 that is wired between the control module 30 and the power supply 38 is closed. The power supply may be a rechargeable power pack or a series of replaceable batteries. In the preferred embodiment it is replaceable batteries. The control module 30 is a microprocessor which incorporates a power distribution module, LED color and intensity module, and optionally (in the case of the alternate embodiments) an accessory socket (USB preferably), the software and hardware to loop a prerecorded video (input via a programmed USB drive) to the video display panels, and a wireless transceiver. The control module may be directly wired to the power supply and operated via a wireless signal sent from a computerized device such as a smart phone.

In other operational modes the mop with UV LEDs may be used to smoothly apply and cure UV hardening floor finishes or to disinfect floors of hospital rooms. In such cases, the power distribution module may incorporate a transformer/inverter/rectifier to supply the correct power necessary from the supplied AC or DC power source. AC power source is optimal for prolonged operation applications such as mentioned above.

Simply stated, the mop is taken onto the floor to quickly remove fluids and restore the floor to a non-slippery state. Before getting there, it is switched on to either illuminate the ring of LED lights, the video display panels, or both. Its unique design draws visual attention, getting the advertising (whether a decal or video burst) out to the crowd.

In other operational modes the mop with UV LEDs may be used to smoothly apply and cure UV hardening floor finishes or to disinfect floors of hospital rooms.

Although described herein as having a circular mop body 10 it is known that there is a multitude of other geometric shape that may be used and that may be better suited to the shape of video display panels. Also although described as having downward facing LEDs, for the creation of the floating mop illusion, the LEDs may be mounted so as to face any direction up to 90 degrees from the downward vertical axis. The color and intensity of the LEDs is controlled by the control module 30.

In the simplest version, the preferred embodiment will have a single color ring of LEDs operated by a pole handle switch that connects power from the power source to the control module and then to the LEDs via the wires connecting them and running through the voids in the core disk. More complex versions are envisioned that utilize multiple Faraday DC power generator tubes in the voids in the bottom of the core disk that generate the DC power to illuminate the LEDs based on the rapid movement of the mop.

While certain features and aspects have been described with respect to exemplary embodiments, one skilled in the art will recognize that numerous modifications are possible. Moreover, while the procedures of the methods and processes for building, assembling and using the devices described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims

Having thus described the invention, what is claimed as new and desired to be secured by Letters Patent is as follows:

1. A mop comprising:

a mop body having a generally planar top deck with a lower surface, said top deck affixed atop a core disk, said lower surface forming an overhang around a periphery of said core disk;

a pole handle;

a swivel connecting said mop body to said pole handle;

a control switch mounted in said mop;

a power supply mounted in said mop;

a control module mounted in said mop, said control module in operational contact with said power supply, said array of LED lights and said control switch;

an operational array of LED lights mounted about an entire perimeter of said mop body on said overhang, said LED lights facing downward when said mop is in use; and when in use, said array of LED lights emit a light ray ring visible to spectators only as reflected off a floor about an entire perimeter of said mop body, said light ray ring no wider than two inches; and wherein when in use by a user, said array of LED lights is not visible to the user pushing said mop.

2. The mop of claim 1 further comprising:

a releasable attachment for a replaceable absorbent mop pad, said releasable attachment affixed to a bottom face of said mop body.

3. The mop of claim 1 wherein said swivel is a bi-axial hinge allowing motion in two vertical planes that reside perpendicular to each other.

4. The mop of claim 1 wherein said pole handle is a length adjustable pole handle with a linear bore formed therein for the placement of wires.

5. The mop of claim 1 wherein said LED lights are equally spaced about an entire 360 degrees of said periphery of said mop body, and wherein said LED lights are ⅛ to 6 inches off of said floor when said mop is in use.

6. The mop of claim 1 wherein said core body has a series of voids formed therein.

7. The mop of claim 6 wherein said series of voids include a control module void, a power supply void and a wire chase void, said control module void housing said control module, said power supply void housing said power supply.

8. The mop of claim 6 wherein said core body is made of a polymer foam.

9. The mop of claim 7 wherein said core body has a depth that is greater than a thickness of said power source and a thickness of said control module.

10. The mop of claim 1 wherein said LED lights are selected from the group comprising UV-C LED lights, or black light LED lights.

11. The mop of claim 1 further wherein said control switch is mounted in said pole handle, said control switch operably connected between said power supply and said control module.

12. The mop of claim 1 wherein said array of LED lights is within the range of ⅛ of an inch to 6 inches from said lower face.

13. The mop of claim 1 wherein said mop body is configured as a planar, circular disk.

* * * * *